United States Patent [19]

Kuhlmann et al.

[11] Patent Number: 4,476,009

[45] Date of Patent: Oct. 9, 1984

[54] PROCESS FOR IMPROVING THE HYDROGEN DONOR PROPERTIES OF A COAL LIQUEFACTION SOLVENT

[75] Inventors: Erven J. Kuhlmann, Wappingers Falls; Richard P. Guptill; Dick Y. Jung, both of Fishkill; Hyung K. Zang, Hopewell Junction, all of N.Y.

[73] Assignee: Texaco Inc., White Plains, N.Y.

[21] Appl. No.: 478,196

[22] Filed: Mar. 24, 1983

[51] Int. Cl.[3] ..... C10G 1/00; C10G 1/06; C10G 45/00

[52] U.S. Cl. ..... 208/8 LE; 208/10; 208/143

[58] Field of Search ..... 208/8 LE, 143, 10

[56] References Cited

U.S. PATENT DOCUMENTS

| | | | |
|---|---|---|---|
| 3,162,594 | 12/1964 | Gorin | 208/10 X |
| 3,518,182 | 6/1970 | Paterson | 208/8 LE X |
| 3,607,719 | 9/1971 | Johnson | 208/10 |
| 4,097,361 | 6/1978 | Ashworth | 208/8 LE |
| 4,119,524 | 10/1978 | Leonard et al. | 208/8 LE |
| 4,222,844 | 9/1980 | Nizamoff | 208/8 LE |
| 4,251,346 | 2/1981 | Dry et al. | 208/8 LE |
| 4,311,578 | 1/1982 | Fant et al. | 208/8 LE |
| 4,318,797 | 3/1982 | Jager et al. | 208/8 LE |
| 4,323,447 | 4/1982 | Tsai et al. | 208/10 X |
| 4,357,228 | 11/1982 | Che | 208/8 LE X |
| 4,374,015 | 2/1983 | Brulé208 | 8 LE/ |

*Primary Examiner*—Delbert E. Gantz
*Assistant Examiner*—William G. Wright
*Attorney, Agent, or Firm*—Robert A. Kulason; James F. Young; James J. O'Loughlin

[57] ABSTRACT

A process for improving the properties of a hydrogen donor coal liquefaction solvent employed in a coal liquefaction process which comprises separating said coal liquefaction solvent into a first fraction boiling in the range from about 350° to about 675° F., and a second fraction boiling in the range from about 675° F. to about 1000° F., hydrogenating said first fraction at a temperature ranging from about 600° to about 800° F., under a pressure of about 500 to 4000 psig, hydrogenating said second fraction at a temperature ranging from about 600° to 700° F. at a pressure from about 500 to 4000 psig and combining said hydrogenated first and second fractions to provide a coal liquefaction solvent having an increased concentration of hydrogen donor components.

5 Claims, No Drawings

PROCESS FOR IMPROVING THE HYDROGEN DONOR PROPERTIES OF A COAL LIQUEFACTION SOLVENT

BACKGROUND OF THE INVENTION

1. Field of the Invention

The invention relates to a hydrogenation process in which different boiling fractions of a coal-derived solvent are subjected to hydrogenating conditions that maximize the concentration of efficient hydrogen-donating hydroaromatics.

There is a continued recognition of the need to improve the hydrogen donating ability of a solvent in a coal liquefaction process. This objective has been sought after by many researchers but a satisfactory solution has yet to be found.

For a long time coal chemistry research has focused on providing more effective hydrogen-donating species for use in coal liquefaction processes. These molecules have the ability to donate hydrogen to liquids being made from coal at elevated temperatures in liquefaction reactors. Liquids are made from the coal when the chemical bonds in a coal molecule are thermally degraded. In the presence of these more effective hydroaromatic species, described in more detail below, the coal conversion in the coal liquefaction reactor is increased as is the production of the more desirable heptane soluble oils (liquids).

In general a coal liquefaction process consists of heating a slurry of coal and some solvent at temperatures of about 700° to 880° F. Heating may occur under a hydrogen atmosphere and at pressures of about 0–4500 psig, usually about 800–3000 psig. Under these conditions the coal is thought to undergo a thermally-induced free radical fragmentation. Coal conversion yields are related to the efficiency with which these free radicals are stabilized. The preferred mode of radical stabilization has been found to occur by hydrogen abstraction from hydroaromatic species that are present in the solvent. Molecular hydrogen is also present during liquefaction reaction in an attempt to replenish the hydrogen consumed from the hydroaromatic species, to stabilize any remaining radicals directly, and to help prevent coking.

A method for treating a coal-derived solvent has now been discovered in which the concentration of efficient hydrogen-donating hydroaromatics is increased. In contradistinction, the prior art hydrogenating processes have, for the most part, sought to maximize without selectivity the concentrations of all hydroaromatics and not just those that have now been found to be more effective hydrogen donors. It was heretofore incorrectly assumed in the prior art that the effectiveness of the solvent was related to the total hydroaromatic content of the solvent.

It has now been found that not all hydroaromatics are equally as effective in donating hydrogen during the coal liquefaction process. In fact, it has been found that tetralin—a hydroaromatic whose presence was sought to be increased in prior hydrogenating methods and which is considered by the art as a representative hydrogen-donating hydroaromatic—is not as effective in donating hydrogen as, for example, tetrahydrofluoranthene and dihydrophenanthrene: these two hydroaromatics were found to be 1130% and 810%, respectively, more reactive than tetralin in the conducted experiment which simulated the reaction conditions that take place during a coal liquefaction reaction.

The known prior art processes tend to be inefficient in that they serve to increase the concentration of certain hydroaromatic compounds which have been found to be less effective hydrogen donors. Although the prior art recognized that, as a class, all hydroaromatics were much better hydrogen donors than either saturates or aromatics, it was not recognized that certain hydroaromatics were surprisingly superior as hydrogen donors in the specific coal liquefaction process. The prior art liquefaction hydrogenating processes are not selective; whereas, the instant invention is highly selective serving to increase the concentration of more highly effective hydrogen-donating hydroaromatics such as tetrahydrofluoranthene and dihydrophenanthrene.

2. Description of the Prior Art

U.S. Pat. No. 4,303,498 discloses in its broadest aspects subjecting the different boiling fractions of a solvent for coal liquefaction to one or more hydrotreating processes. It was found that the fraction boiling at more than 485° F. possessed virtually no hydrogen-donating properties, but the fraction boiling at less than 485° F. did comprise hydrogen-donating substances when hydrogenated. It was accordingly subjected to hydrogenating treatment, with the fraction boiling from 390°–415° F. preferably hydrogenated once, and the fraction boiling from 415°–485° F. preferably hydrogenated twice. Hydrogenation conditions were the same for each boiling fraction; a reaction temperature of 750° F., a reactor time of 60 minutes, and an initial hydrogen pressure of 70 kg/cm$^2$ G. Thereafter, the fractions boiling at below and above 415° F. were recombined in certain set proportions. By subjecting the fraction boiling at 415°–485° F. to two hydrogenating treatments, the heavy liquid was first dealkylated and subsequently hydrogenated—that is, alkylnaphthalene and other components of the heavy liquid were dealkylated to form naphthalene and subsequently hydrogenated into tetralin.

U.S. Pat. No. 3,726,785 discloses liquefying a first and second slurry of a particular coal employing two separately obtained coal-derived solvents. A coal-derived solvent is separated into what is called a high and a low boiling solvent fraction at a temperature cutoff of preferably about 500°–600° F. Each fraction is then separately hydrogenated in a hydrogenation reactor at a temperature within the range from about 650°–850° F., preferably about 700° F., and pressures in the range from about 650 psig to about 2000 psig, preferably about 1300 psig. With each of these solvents a separate slurry of coal is formed and, in turn, the slurries are separately liquefied.

U.S. Pat. No. 4,323,447 discloses a coal liquefaction process in which the coal liquefaction solvent containing tetrahydrophenanthrene is subjected to downstream catalytic hydrogenation to convert a portion of the tetrahydrophenanthrene (THP) present therein to octahydraphenanthrene (OHP). The hydrogenation reaction is conducted under temperatures between about 644° and 725° F. and with hydrogen partial pressures in the range of about 1000 to 2500 psi and a liquid hourly space velocity (LHSV) of between about 0.2 and about 10 hr$^{-1}$.

U.S. Pat. No. 4,311,578 discloses a method wherein a solvent or diluent employed in a liquefaction of solid carbonaceous material comprises from about 65 to 85 wt % of hydroaromatic components. A solvent fraction separated out from the liquefaction product is subjected to hydrogenation and the naphthenic components contained therein are extracted. These extracted naphthenic components are then dehydrogenated and subsequently hydrotreated to produce additional hydroaromatic compounds that are then returned to the solvent from which they were extracted.

Paper 62*b* entitled "Coal Solvolysis in a Series of Model Compound Systems" presented on Nov. 18, 1982 at the AICHE 1982 Annual Meeting discloses that the hydrogen donor content of a solvent alone would not be sufficient to completely define its effectiveness as a coal liquefaction solvent, that is, different donors have different abilities to liquefy coal.

SUMMARY OF THE INVENTION

Discovery has been made that certain hydroaromatics are more efficient hydrogen donors than other hydroaromatics in a coal liquefaction process, and, also, of a method for maximizing the concentration of these efficient hydroaromatics.

The coal-derived liquid which is to be hydrogenated into the coal liquefaction solvent is first separated into two fractions (an overhead and a bottoms fraction) in a conventional vacuum distillation tower at a vacuum cut point equivalent to about 675° F. at 1 atmosphere absolute pressure. The overhead fraction (that fraction boiling at less than about 675° F.) is hydrotreated at the following conditions: a reaction temperature of about 600°-800° F., a pressure in the range from about 500-4000 psig, and a LHSV of about 0.2-4.0 $hr^{-1}$; and the bottoms fraction (that fraction boiling at a temperature greater than about 675° F.) is hydrotreated at the following conditions: a reaction temperature of about 600°-700° F., a pressure in the range from about 500-4000 psig, and a LHSV of about 0.2-4.0 $hr^{-1}$. After separately hydrotreating these fractions, they are then recombined in the same ratios they were present prior to fractionation, that is, about 75% overhead (lower boiling fraction) and 25% bottoms (higher boiling fraction).

DETAILED DESCRIPTION OF THE INVENTION

In experiments conducted, hydrogenated creosote oils were evaluated as solvents for coal liquefaction. More specifically, the efficiency of the different hydroaromatics contained in the hydrogenated creosote oil in donating hydrogen was sought to be determined.

Creosote oil is obtained from the distillation of crude oil tar. Light creosote is obtained by rectification of coal tar from a continuous vertical retort in the temperature range of from about 238° C. to about 291° C., creosote in the temperature range of from about 271° C. to about 362° C. and heavy creosote (and heavy oil) in the temperature range of from about 285° C. to about 395° C. For a coal tar from a coke oven, the corresponding temperature ranges are from about 224° C. to about 286° C. for light creosote, from about 247° C. to about 355° C. for heavy creosote (and anthracene oil) and from about 323° C. to about 372° C. for heavy oil. The foregoing oils, when mixed to meet some specific requirements, are referred to as "creosotes" or "creosote oils". See Kirk-Othmer, "Encyclopedia of Chemical Technology", Second Edition, Vol. 19 p. 668 and p. 679.

The efficiency of the hydroaromatics contained in creosote oil solvents was evaluated in the following manner: 3 grams of dry −200 to +320 mesh Illinois No. 6 bituminous coal and 6 grams of the hydrotreated solvent were placed in a 30 ml bomb microreactor under 600 psi $H_2$. Fast heat up times were obtained by immersion of the microreactor in a preheated molten salt bath. After the desired reaction times were obtained, that is, at 2, 3, 4, 5, 6, 8, and 10 minute intervals, the 30 ml tubes were quenched in a water bath and depressurized. The liquefaction product was then filtered through a glass frit using, when necessary, a pyridine wash.

By comparison of the compositional changes in the reacted solvents, and assuming pseudo 1st order kinetics, it was possible to rank the various hydroaromatics contained in the hydrotreated creosote oil according to their effectiveness in donating hydrogen. Compositional changes in these reacted solvents were determined by gas chromatographic/spectrometric analysis; the solvent was analyzed before the reaction and after, and the rate differences (that is, the rate of disappearance of various hydroaromatics over the 7 reaction time intervals) were thus calculated. The results are presented in the following table:

TABLE I

Relative Rate Constants for Hydrogen Donation During Coal Liquefaction

| Potential H donors | Relative Rate |
|---|---|
| 1,2,3,10b-tetrahydrofluoranthene | 2.5 |
| 9,10-dihydrophenanthrene | 1.8 |
| 4,5,9,10-tetrahydropyrene | 1.8 |
| 1,2 or 1,4-dihydronaphthalene | 1.6 to 2.3 |
| 2a,3,4,5-tetrahydroacenaphthene | 1.0 |
| 4,5-dihydropyrene | 0.72 |
| 1,2,3,4,5,6,7,8-octahydrophenanthrene | 0.59 |
| decahydrofluoranthrene | 0.35 |
| tetralin | 0.22 |
| 1,2,3,4,-tetrahydrophenanthrene | −0.13 (being formed in situ faster than it reacts) |

It is assumed in conducting this experiment that all hydroaromatics species are thermally stable under reaction conditions in the absence of coal; therefore it follows that the rate of disappearance of the hydroaromatics during the coal liquefaction is the measure of the species effectiveness in stabilizing the free radicals formed from coal.

Thus, from appreciation of the results in the Table I, it is preferred that solvents employed in coal liquefaction contain one or more, or all, of these effective hydrogen donors: in particular tetrahydrofluoranthene, or any species listed in Table I from tetrahydrofluoranthene through dihydropyrene (inclusive). These hydroaromatics are more effective than conventionally employed hydroaromatics in increasing both total coal conversion and coal conversion to the more desirable heptane soluble oil.

Octahydrophenanthrene, tetralin, tetrahydrophenanthrene (the 7th, 9th and 10th hydroaromatic noted in Table I) are not employed because in addition to their low rate of hydrogen donation, they have a propensity for isomerization. Several of these formed isomer species are classified as non-donors.

A problem was now realized: those hydroaromatics having greater hydrogen donating ability than tetralin required hydrotreating at different pressures, temperatures, and LHSV's in order for their amounts to be maximized, for one set of hydrotreating conditions does not allow selectivity in the types of hydroaromatics produced. For example, tetrahydrofluoranthene and dihydropyrene, both excellent hydrogen donor species, are produced in maximum concentrations at a hydrotreating temperature of 650° f. and hydrogen pressure of 1500 psig; but, on the other hand dihydrophenanthrene, also an excellent hydrogen donor specie, is produced in greatest concentrations at a hydrotreating temperature of 725° F. and hydrogen pressure of 1000 psig.

As a solution to this problem it was realized that the first two named hydroaromatics (i.e., tetrahydrofluoranthene and dihydropyrene) have a different boiling point than the third named hydroaromatic (i.e., dihydrophenanthrene) and, thus, a method can be devised which will allow separation of the coal-derived liquid into fractions, so that each derived liquid can be separately treated. By allowing for separate catalytic hydrogenation steps for each of the two fractions, the amounts of effective hydroaromatic contained within each fraction can be maximized.

In the instant invention a conventional vacuum distillation tower was employed to separate the coal derived liquid into two fractions. The vacuum cut point employed is equivalent at 1 atmosphere to a cut point temperature range of 625° to 710° F.

The overhead and bottoms fractions were then catalytically hydrogenated, one independently of the other, over a sulfur-nitrogen-resistant hydrotreating catalyst. Although a catalyst comprised of cobalt-molybdenum is preferred, other conventional hydrogenation catalysts may be employed. Typically, these catalysts comprise an alumina or silica-alumina support carrying one or more Group VIII metals and one or more metals of group VI-B of the periodic table in the form of oxides or sulfides. In particular, a combination of one or more Group VI-B metal oxides or sulfides and one or more iron Group VIII metal oxides or sulfides is preferred.

The overhead fraction (containing phenanthrene and those species boiling below phenanthrene) are hydrotreated under the following conditions: a reactor temperature of about 600°-800° F., about 500-1400 psig total system pressure, and LHSV of 0.2 to 4.0 $hr^{-1}$, preferably about 710°-740° F., about 800-1200 psig and LHSV of about 1.2-1.3 $hr^{-1}$. The bottoms fraction (containing fluoranthene, pyrene, and those components boiling at higher temperatures than pyrene) are hydrotreated at the following conditions: a reactor temperature of about 600°-700° F., about 500-4000 psig total system pressure, and LHSV of about 0.2 to 4.0 $hu^{-1}$, preferably about 625°-675° F., about 1300 to 1700 psig and LHSV of about 1.2-1.7 $hr^{-1}$.

After these hydrotreated coal liquids have been independently produced, they can then be recombined in their original proportions, that is, preferably 75% overhead and 25% bottoms. As found, the resulting liquefaction solvent mixture, due to the increased concentration of active hydrogen donors, represents an improvement over a solvent which was produced in a single hydrotreating step.

Also, if desired, the hydrotreated coal liquids may be recombined in ratios different than that which they were found in the coal liquefaction solvent prior to treatment; for example, the bottoms fraction may comprise more than 25% of the recombined solvent. This is necessary in instances where a higher concentration of preferred hydroaromatics is desired: the bottoms fraction contains tetrahydrofluoranthene, the most efficient hydroaromatic. The limit as to how much of the solvent may be comprised of bottoms fraction is determined only by practical considerations. As the bottoms content in the solvent increases it becomes more and more difficult to pump and transport the solvent in the system. This factor, along with economic concerns, serves to determine to what extent, if at all, the bottoms fraction present in the treated recombined solvent is in excess of that which was present in the pre-treated solvent.

The following experiment was conducted to show that the separate hydrotreating of different boiling fraction of a coal derived liquid at different hydrotreating temperatures, pressures and LHSV's, produces, when the hydrotreated fractions are recombined, a coal liquefaction solvent in which the preferred more efficient hydroaromatics are increased in concentration over that of a coal derived liquid which was conventionally treated in a single step process. The efficiency of the two methods was compared by determining the percentage amounts of dihydrophenanthrene and tetrahydrofluoranthene (the two most preferred hydroaromatics) comprising the differently treated solvents. This determination of hydroaromatic content was accomplished by means of gas chromatography.

EXAMPLES

EXAMPLE I

Creosote oils[1] were treated in a single hydrotreating step; that is, the creosote oils were hydrotreated at a temperature of 750° F., a pressure of 1000 psig, a 1.0 $hr^{-1}$ LHSV. The hydrogen treat rate in Run 1 and Run 2 was 5419.5 and 6166.4 SCF/bbl, respectively. The percentage amounts comprising each of the two runs of dihydrophenanthrene and tetrahydrofluoranthene were determined and an average (based on the two runs) was calculated.

[1] The creosote oils employed both in Example I and Example II are the 400°-850° F. cuts of coal tar obtained from the destructive distillation of bituminous coal.

EXAMPLE II

| Run # | % Dihydrophenanthrene | % Tetrahydrofluoranthene |
|---|---|---|
| 1 | 2.89 | 1.66 |
| 2 | 3.20 | 1.70 |
| Average | 3.04 | 1.68 |

Creosote oils were fractionated, independently hydrotreated, and then recombined. The distilled overhead fraction boiling at less than 700° F. was hydrotreated in Runs 3*a* and 4*a* at a temperature of 750° F., a pressure of 1000 psig, and 1.0 $hr^{-1}$ LHSV. The bottoms fraction boiling at more than 700° F. was hydrotreated in Runs 3*b* and 4*b* at a temperature of 650° F., a pressure of 1000 psig, and 0.5 $hr^{-1}$ LHSV. The hydrogen treat rate in runs 3*a* and 4*a* was 6046.1 and 6414.5 SCF/bbl, respectively, in Runs 3*b* and 4*b*, 8660.9 and 9052.3 SCF/bbl, respectively. The percentage amounts comprising each of the four runs of dihydrophenanthrene and tetrahydrofluoranthene were determined.

| Run # | % Dihydrophenanthrene | % Tetrahydrofluoranthene |
|---|---|---|
| 3a (overhead) | 3.02 | 0.07 |
| 4a (overhead) | 2.54 | 0.12 |
| 3b (bottoms) | 5.28 | 12.42 |

-continued

| Run # | % Dihydrophenanthrene | % Tetrahydrofluoranthene |
|---|---|---|
| 4b (bottoms) | 9.85 | 14.93 |

Run 3*a* and Run 3*b* were combined in the proportions which they were present before hydrotreatment (77.5% of 3*a* (overhead) to 22.5% of 3*b* (bottoms)) to give OIL A.

Run 4*a* and Run 4*b* were combined in the proportions which they were present before hydrotreatment (77.5% of 4*a* (overhead) to 22.5% of 4*b* (bottoms)) to give OIL B.

The Example II oils after recombination have the following concentrations of hydrogen donor species:

| Oil | % Dihydrophenanthrene | % Tetrahydrofluoranthene |
|---|---|---|
| A | 3.52 | 3.41 |
| B | 4.18 | 3.45 |
| Average | 3.85 | 3.43 |

As is demonstrated from the test, oil A and oil B of Example II (which were each separately fractionated and the fractionated portions treated at different hydrotreating temperatures, pressures and LHSV's and subsequently recombined) contain a greater percentage amount of dihydrophenanthrene and tetrahydrofluoranthene than do the oils of Example I which were hydrotreated under one set of conditions. The amount (percentage) of dihydrophenanthrene in oils A and B of Example II is 3.52 and 4.18, respectively, and the amount (percentage) of tetrahydrofluoranthene contained therein is 3.41 and 3.45, respectively. In the two oils of Example I the amount (percentage) of dihydrophenanthrene produced ranges from 2.89 in the first trial to 3.20 in the second trial, and the amount (percentage) of tetrahydrofluoranthene ranges from 1.66 in the first trial to 1.70 in the second. As these results indicate, the concentration of these preferred hydroaromatics has been increased: in the case of tetrahydrofluoranthene the amount present in the oils of Example II is, based on an average, more than 200% greater than that present in the oils of Example I; and in the case of dihydrophenanthrene the amount present in the oils of Example II is, based on average, 120% greater than that in the oils of Example I.

As a result of the instant invention, it has been unexpectedly and surprisingly found that (A) certain hydroaromatics are more efficient than others in donating their hydrogen to stabilize coal molecule fragments formed in the liquefaction process and (B) the concentration of these more efficient hydroaromatics can be increased by separately treating different fractions of the coal derived solvent at different temperatures, pressures and LHSV's.

What is claimed is:

1. A process for improving the hydrogen donor properties of a coal liquefaction solvent for a coal liquefaction process which comprises separating a coal liquefaction solvent having a boiling range from about 350° to 1000° F. into a first fraction boiling in the range from about 350° to about 675° F. and a second fraction boiling in the range from about 675° F. to about 1000° F., hydrogenating said first fraction at a temperature ranging from about 700° to about 800° F. under a pressure of about 500 to 2500 psig, hydrogenating said second fraction at a temperature ranging from about 600° to 700° F. at a pressure from about 500 to 2500 psig and combining said hydrogenated first and second fractions to provide a coal liquefaction solvent having an increased concentration of hydrogen donor components.

2. A process according to claim 1 wherein said first fraction is hydrogenated at a temperature ranging from 710° to 740° F. and a pressure of 800 to 1200 psig and 1.0—1.5 $hr^{-1}$ LHSV and said second fraction is hydrogenated at a temperature ranging from about 625° to 675° F. and a pressure of 1300 to 1700 psig and 1.5—2.0 $hr^{-1}$ LHSV.

3. A process according to claim 1 wherein the hydrogen donor whose concentration is sought to be maximized is selected from the group consisting of 1,2,3, 10b-tetrahydrofluoranthene, 9,10-dihydrophenanthrene, 4,5,9,10-tetrahydropyrene, and 2a,3,4,5,-tetrahydroacenaphthene and their alkyl derivatives.

4. A process for coal liquefaction in which the hydrogen donor solvent employed is produced in a process according to claim 1.

5. A process for improving the hydrogen donor properties of a coal-derived solvent for a coal liquefaction process which comprises separating a coal derived solvent into a first fraction boiling at a temperature in the range of about 350° to 675° F. and comprising the total amount of phenanthrene present in the solvent and a second fraction boiling in the range of about 675° to 1000° F. and comprising the total amount of fluoranthene present in the solvent, hydrogenating said first fraction at a temperature of about 710° -740° F., a pressure of about 800–1200 psig to maximize the production of 9,10-dihydrophenanthrene, and hydrogenating said second fraction at a temperature of about 625°–675° F., a pressure of about 1300–1700 psig to maximize the production of 1,2,3,-10b-tetrahydrofluoranthene, and combining said first and second hydrogenated fractions.

* * * * *